US008806820B2

(12) United States Patent
Ahn

(10) Patent No.: US 8,806,820 B2
(45) Date of Patent: Aug. 19, 2014

(54) SEGMENTS FOR BUILDING SPLICED PRESTRESSED CONCRETE GIRDER AND METHOD OF MANUFACTURING THE SEGMENTS

(75) Inventor: Jeong-Saeng Ahn, Goyang (KR)

(73) Assignee: Interconstec Co., Ltd., Seoul (KR)

( * ) Notice: Subject to any disclaimer, the term of this patent is extended or adjusted under 35 U.S.C. 154(b) by 1636 days.

(21) Appl. No.: 11/918,451

(22) PCT Filed: Apr. 5, 2006

(86) PCT No.: PCT/KR2006/001253

§ 371 (c)(1),
(2), (4) Date: Oct. 15, 2007

(87) PCT Pub. No.: WO2006/109952

PCT Pub. Date: Oct. 19, 2006

(65) Prior Publication Data

US 2009/0064610 A1 Mar. 12, 2009

(30) Foreign Application Priority Data

Apr. 13, 2005 (KR) ..... 10-2005-0030720

(51) Int. Cl.

| | |
|---|---|
| ***E04C 5/08*** | (2006.01) |
| ***E04B 1/00*** | (2006.01) |
| ***E04G 21/00*** | (2006.01) |
| ***E04G 23/00*** | (2006.01) |

(52) U.S. Cl.
USPC ..... 52/223.11; 52/848; 52/742.14

(58) Field of Classification Search
USPC ..... 52/223.1, 223.4, 223.5, 223.8, 223.9, 52/223.11, 334, 326, 327, 432, 742.1, 52/742.14, 745.17, 745.18, 848; 264/228
See application file for complete search history.

(56) References Cited

U.S. PATENT DOCUMENTS 2,208,814 A * 7/1940 Peabody ..... 52/285.1
3,284,977 A 11/1966 Lickliter et al.

(Continued)

FOREIGN PATENT DOCUMENTS

JP 11-293629 A 10/1999
KR 10 2004 004337 A 5/2004
KR 10-2004-0043377 5/2004

OTHER PUBLICATIONS http://www.merriam-webster.com/dictionary/end; date visited Jan. 29, 2010.*

(Continued)

*Primary Examiner* — Joshua J Michener
*Assistant Examiner* — Theodore Adamos
(74) *Attorney, Agent, or Firm* — Ladas & Parry LLP

(57) ABSTRACT

Provided are segments of a spliced prestressed concrete girder, which have improved structural integrity at joints, and a method of manufacturing the segments. The method of manufacturing the segments, which are combined to build the spliced prestressed concrete girder, includes: manufacturing one or more joint blocks, each having a first end that has a shear key and is to be spliced to an end of an adjacent segment and having a second end that is bonded to a segment body of the segment; and manufacturing the segment body by using the one or more joint blocks as one or more ends of a formwork in which the segment body is to be made and by casting and curing concrete in the formwork, wherein the one or more joint blocks are fixedly bonded to one or more ends of the segment body in the manufacturing of the segment body.

6 Claims, 8 Drawing Sheets

(56) References Cited

U.S. PATENT DOCUMENTS

| | | | | | |
|---|---|---|---|---|---|
| 3,356,398 | A | * | 12/1967 | Nilsson et al. | 403/331 |
| 3,593,532 | A | * | 7/1971 | Grazel | 405/252 |
| 3,794,433 | A | | 2/1974 | Schupack | |
| 3,810,337 | A | * | 5/1974 | Pollard | 52/223.8 |
| 3,892,096 | A | * | 7/1975 | Macchi | 52/223.11 |
| 4,009,550 | A | * | 3/1977 | Young | 405/251 |
| 4,604,003 | A | * | 8/1986 | Francoeur et al. | 405/256 |
| 4,604,841 | A | * | 8/1986 | Barnoff et al. | 52/174 |
| 4,733,986 | A | | 3/1988 | Kenning et al. | |
| 4,993,095 | A | | 2/1991 | Lautensleger et al. | |
| 5,305,573 | A | * | 4/1994 | Baumann | 52/848 |
| 5,437,072 | A | | 8/1995 | Dinis et al. | |
| 5,459,973 | A | * | 10/1995 | Baumann | 52/848 |
| 5,577,284 | A | | 11/1996 | Muller | |
| 5,688,069 | A | * | 11/1997 | Hoshino | 403/340 |
| 5,785,419 | A | * | 7/1998 | McKelvey | 366/6 |
| 6,402,435 | B1 | * | 6/2002 | Lewis | 405/284 |
| 6,751,821 | B1 | * | 6/2004 | Han | 14/74.5 |
| 2006/0137115 | A1 | * | 6/2006 | Park | 14/74.5 |

OTHER PUBLICATIONS

International Search Report for PCT/KR2006/001253 dated Jul. 6, 2006.

Office Action dated Jul. 14, 2009 in corresponding Canadian Application No. 2,603,559.

* cited by examiner

SEGMENTS FOR BUILDING SPLICED PRESTRESSED CONCRETE GIRDER AND METHOD OF MANUFACTURING THE SEGMENTS

CROSS-REFERENCE TO RELATED PATENT APPLICATION

This application claims the benefit of Korean Patent Application No. 10-2005-0030720, filed on Apr. 13, 2005, in the Korean Intellectual Property Office, the disclosure of which is incorporated herein in its entirety by reference.

BACKGROUND OF THE INVENTION

1. Field of the Invention

The present invention relates to segments of a spliced prestressed concrete girder and a method of manufacturing the segments, and more particularly, to segments of a spliced prestressed concrete girder, which have improved structural integrity at joints, and a method of manufacturing the segments.

2. Description of the Related Art

A spliced prestressed concrete girder is an integral type prestressed concrete girder which is manufactured as a plurality of segments and then transported to a construction site where the segments are connected to one another and tendons are tensioned in the girder a longitudinal direction thereof.

The segments of the spliced prestressed concrete girders can be connected by a cast-in-place method of placing the segments at the construction site at predetermined intervals, splicing reinforcing bars, and casting concrete, mortar, or grout around the reinforcing bars. A method of thinly coating an adhesive, such as epoxy, over joint surfaces of the segments, or a method of securing the segments using only the tensile force of the tendons without any adhesive are other methods for connecting the segments.

The cast-in-place method wherein concrete, mortar, or grout is cast at joints has an advantage in that the segments which are to be connected do not need to have the mating cross-sections, but has disadvantages of complex construction process and long construction cycle because the reinforcing bars should be placed between the segments and concrete, mortar, or grout should be cast and cured.

The method of securing the segments using the tensile force of the tendons with or without epoxy can significantly reduce construction cycle time and incur low costs, compared to the cast-in-place method, since as shown in FIGS. 1 and 2, a girder 9 is built by connecting prefabricated segments 1 using joints with shear keys 2. However, the method of securing the segments using the tensile force of the tendons has a drawback in that the segments 1 to be connected should have the precisely mating cross-sections. Also, it is difficult to fabricate the segments 1 because corresponding concave-convex portions of the shear keys between the connected segments 1 should be mated completely or within a thin adhesive thickness range despite the fact that the joints of the segments 1 have complex shapes due to the shear keys 2, guide keys, tendon ducts, and so on. In addition, the girder 9 is structurally weak because longitudinal reinforcing bars are discrete at the joints and stress concentration at joints may happen due to a manufacturing error or improper epoxy preparation or application.

Also, since existing formworks in which the segments 1 are made are expensive, the lengths of the segments have been standardized and only girders or segments having the standard lengths have been manufactured, thereby making it difficult to manufacture segments or girders of various lengths.

SUMMARY OF THE INVENTION

According to an aspect of the present invention, there is provided a method of manufacturing a segment which is used to build a spliced prestressed concrete girder by combining a plurality of the segments, the method comprising: manufacturing one or more joint blocks, each having a first end that has a shear key and is to be spliced to an end of an adjacent segment and having a second end that is bonded to a segment body of the segment; and manufacturing the segment body by using the one or more joint blocks as one or more ends of a formwork in which the segment body is to be made and by casting and curing concrete in the formwork, wherein the one or more joint blocks are fixedly bonded to one or more ends of the segment body in the manufacturing of the segment body.

According to another aspect of the present invention, there is provided a plurality of segments for building a spliced prestressed concrete girder, each of the segments comprising: one or more joint blocks, each having a first end that has a shear key and is to be spliced to an end of an adjacent segment; and a segment body manufactured by using the one or more joint blocks as one or more ends of a formwork in which the segment body is to be made and by casting and curing concrete in the formwork, wherein the one or more joint block are fixedly bonded to one or more ends of the segment body during the manufacturing of the segment body.

Reinforcing bars may be embedded in each of the joint blocks and ends of the reinforcing bars may protrude from a surface of the second end of the joint block, wherein the ends of the reinforcing bars protruding from the surface of the second end of the joint block are fixedly inserted into the segment body.

The material forming each of the joint blocks may have a greater strength than the segment body.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
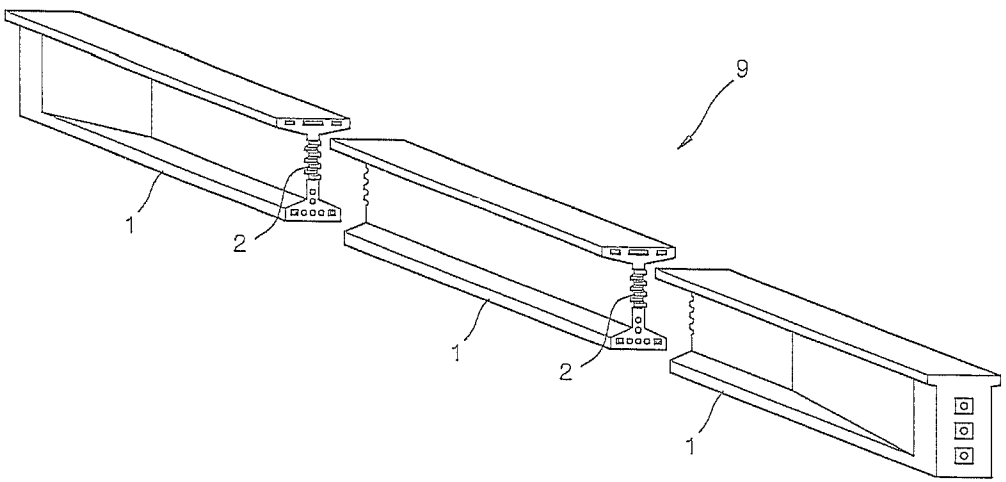
PRIOR ART FIG. 1
FIG. 1 is an exploded perspective view of a conventional match-cast spliced prestressed concrete girder divided into segments.
Figure 2:
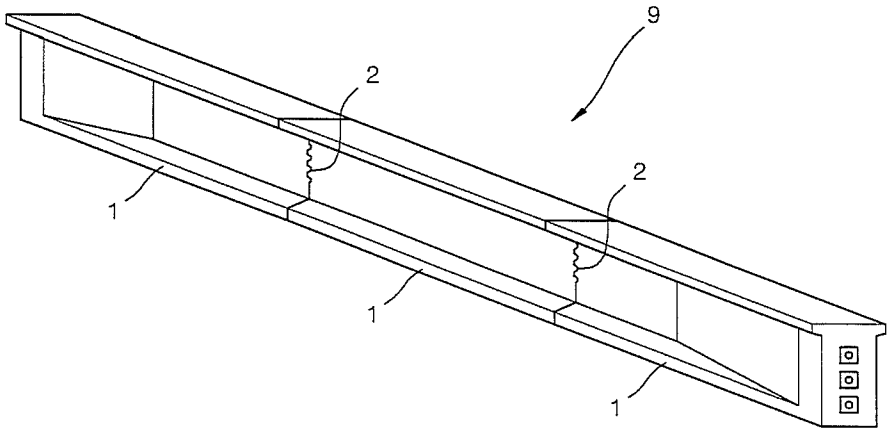
PRIOR ART FIG. 2
FIG. 2 is a perspective view of the girder of FIG. 1, illustrating a state where the segments are connected to one another.
Figure 3:
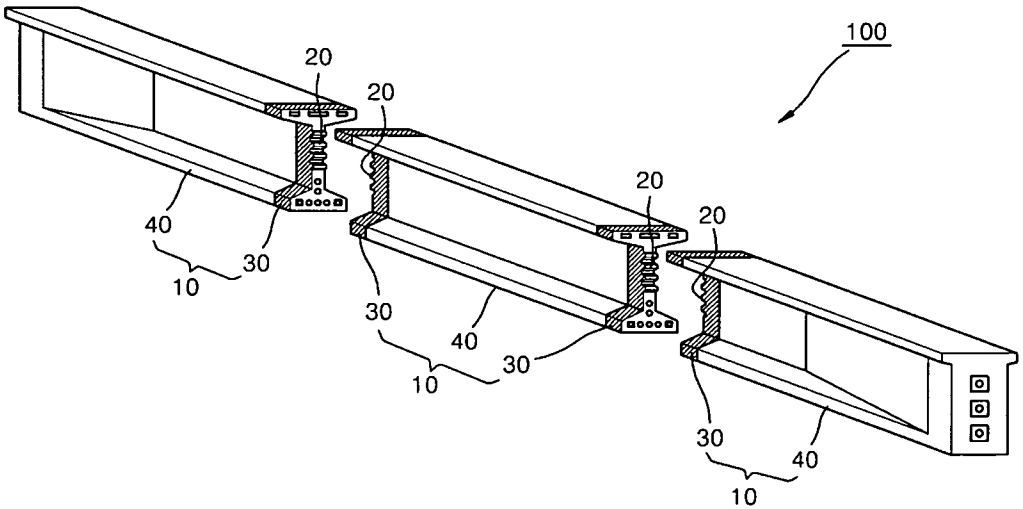
FIG. 3 is an exploded perspective view of a spliced prestressed concrete girder that is divided into segments according to an embodiment of the present invention.
Figure 4:
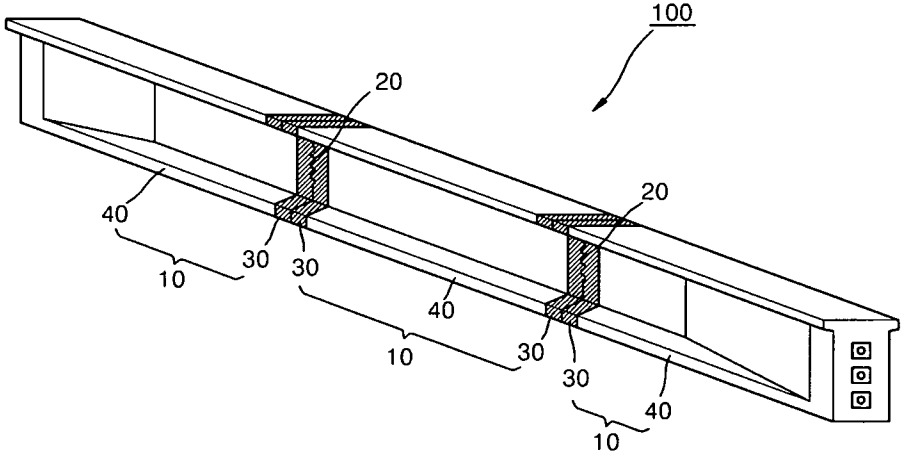
FIG. 4 is a perspective view of the spliced prestressed concrete girder of FIG. 3, illustrating a state where the segments are connected to one another.

FIG. 3 is an exploded perspective view of a spliced prestressed concrete girder 100 that is divided into segments 10 according to an embodiment of the present invention. FIG. 4 is a perspective view of the spliced prestressed concrete girder 100 of FIG. 3, illustrating a state where the segments 10 are connected to one another.

Figure 5A:
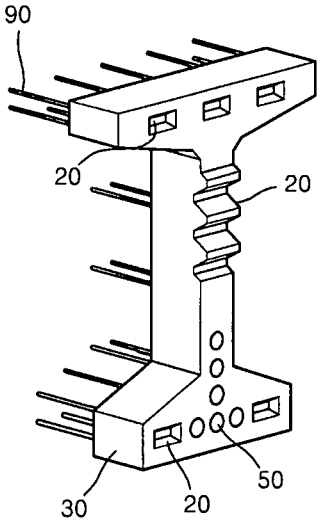
FIGS. 5A through 5C are perspective views of joint blocks of the segments of FIG. 3.
Figure 5B:
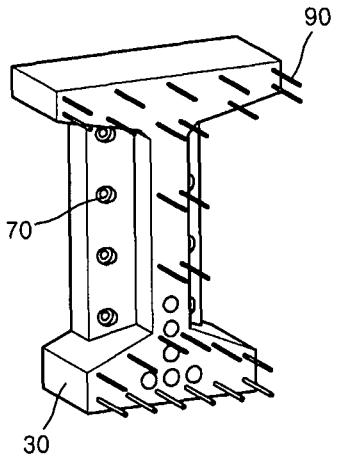
Figure 5C:
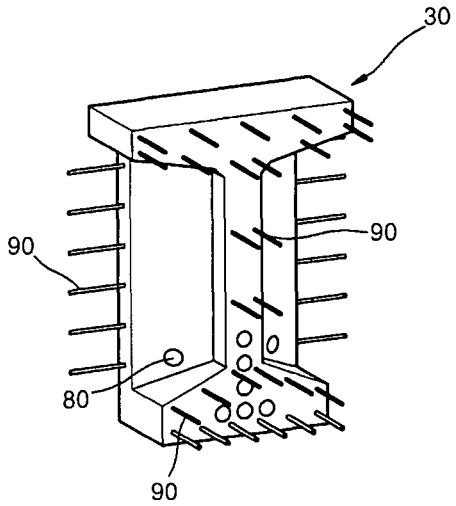

Referring to FIGS. 3 and 4, the segments 10 are combined to build the spliced prestressed concrete girder 100. The segment 10 includes two joint blocks 30 and a segment body 40. FIGS. 5A through 5C are perspective views of examples of the joint blocks of FIG. 3.

A first end of each of the two joint blocks 30 has a shear key 20 and is to be spliced to another segment. Tendon ducts 50 in which tendons are accommodated are installed in the joint blocks 30. Reinforcing bars 90 are embedded in the joint block 30. Ends of the reinforcing bars 90 protrude from a surface of a second end of the joint block 30.

The joint block 30 may have the same cross-section as the segment body 40. However, the joint block 30 may have a cross-section different from that of the segment body 40 in order to reduce stress applied to a joint and increase a shear area, to install a tensioning device or a tensile reinforcing device for the joint, or to connect a cross beam to the joint. Various examples of the joint block 30 are shown in FIGS. 5A through 5C. Steel material holes 70 for connecting the segments 10 using steel materials as shown in FIG. 5B, or an external tendon hole 80 through which an external tendon passes may be formed in the cross-section of the joint block 30 as shown in FIG. 5C. However, the joint block 30 is not limited to these examples and thus modifications can be made without departing from the spirit and scope of the present invention.

Figure 6:
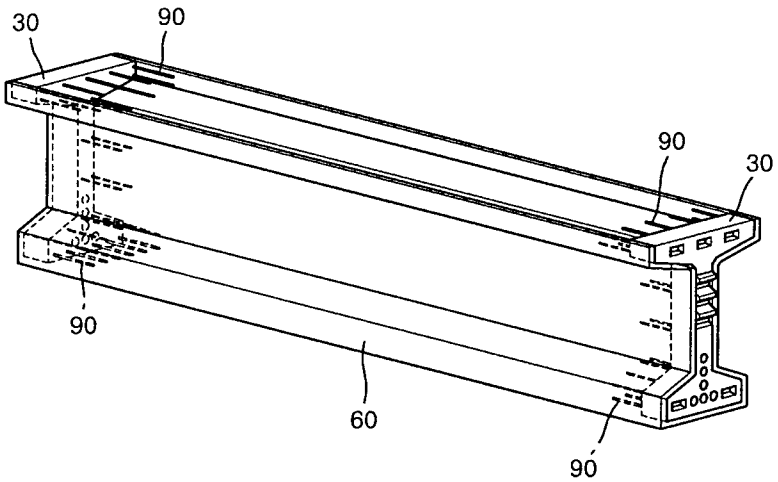
FIGS. 6 and 7 are perspective views illustrating a method of manufacturing segments according to an embodiment of the present invention.

The segment body 40 is bonded to the joint blocks 30 to form the segment 10 as shown in FIG. 3. A method of manufacturing the segments 10 is described with reference to FIG. 6. The segment body 40 is manufactured by using the joint blocks 30 as both ends of a formwork 60 in which the segment body 40 is to be made, that is, by locating the joint blocks 30 at both the ends of the formwork 60 and casting and curing concrete in the formwork 60.

The reinforcing bars 90 protruding from the second end of each of the joint blocks 30 are placed in the concrete that is cast in the formwork 60 such that the reinforcing bars 90 are inserted into the segment body 40.

The concrete of the joint blocks 30 may have a greater strength than that of the segment body 40. In this case, structural weakness at joints due to stress concentration produced by a disruption of the longitudinal reinforcing bars 90 or an error at the joints can be more effectively coped with compared to a case where the joint blocks 30 and the segment body 40 are made of concretes with the same strength. Concrete with a compressive strength of 35 to 55 MPa is generally used for segments, although concrete with a higher strength of 100 to 200 MPa is occasionally used. To enable the joint blocks 30 to have a greater strength than the segment body 40, the segment body 40 may be made of the concrete of 35 to 55 MPa while the joint blocks 30 may be made of the high strength concrete of 100 to 200 MPa.

A method of manufacturing the segments 10 of the spliced prestressed concrete girder 100 according to an embodiment of the present invention will now be explained.

First, each of the joint blocks 30 is manufactured using a separate formwork so that a first end of the joint block 30 that is to be spliced to another segment 10 can have the shear key 20 and ends of the reinforcing bars 90 embedded in the joint block 30 can protrude from a second end of the joint block 30.

Since the joint block of the segment 10 is separately manufactured, the joint block 30 can be smaller than the segment 10 and concrete can be cast by being downward the section of the first end of the joint block 30 thereby making it possible to manufacture precisely the joint block 30 with a complex shape. If the section with the shear key 20 is disposed on a lateral side of the formwork and concrete is cast, although unset concrete has fluidity it is difficult to compactly fill the formwork with the concrete since sand or gravel is contained in the concrete. However, when the section with the shear key 20 is disposed on a lower side and concrete is cast as in the present embodiment, the concrete can be compactly filled even though the section is complex, thereby achieving a more precise manufacturing process than the case where the section with the shear key 20 is disposed on the lateral side of the formwork. Also, a match-cast method in which one of the pair of joint blocks 30 is previously manufactured and then the other is manufactured using the previously manufactured joint block 30 as a part of the formwork 60 can be used, thereby making it easy to manufacture the match-cast pair of joint blocks 30. Even when the pair of joint blocks 30 are manufactured using different formworks instead of the match-cast method, the joint blocks 30 are much lighter than the segment 10, so a precision test for the joint blocks 30 can be more easily performed than a precision test for the segment 10. Accordingly, loss caused when the whole segment 10 needs to be remanufactured due to a joint error can be avoided.

After the joint blocks 30 are manufactured, the joint blocks 30 are disposed at both ends of the formwork 60 in which the segment body 40 is to be made, and concrete is cast by using the joint blocks 30 as the both ends of the formwork 60. Then, the reinforcing bars 90 protruding from the joint blocks 30 are placed in the concrete cast to form the segment body 40.

After a predetermined period of time elapses, the concrete cast in the formwork 60 is cured while being in contact with the joint blocks 30 to form the segment body 40. Accordingly, when the segment body 40 is completed, the joint blocks 30 are bonded to the segment body 40. During this process, the reinforcing bars 90 placed in the concrete cast to form the segment body 40, are inserted into the segment body 40 to reinforce the bonding strength between the segment body 40 and the joint blocks 30 and to avoid structural weakness occurring between the joint blocks 30 and the segment body 40.

Figure 7:
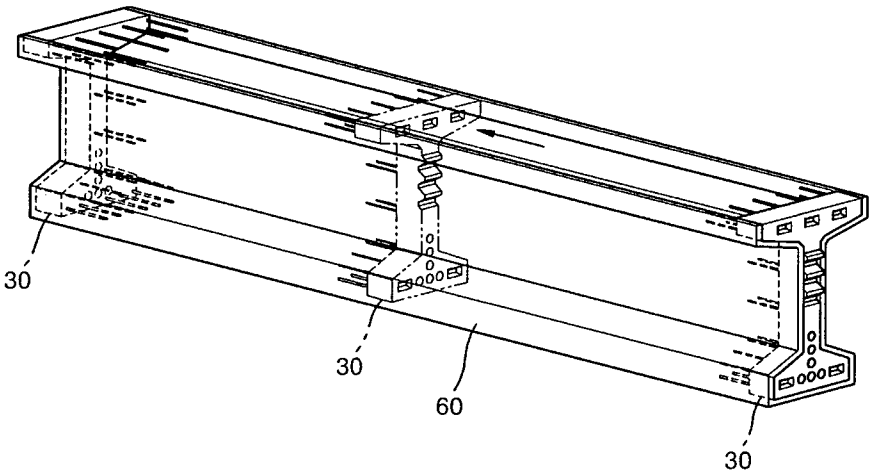

When the segment body 40 and the joint blocks 30 have the same cross-section, segments 10 having various lengths can be manufactured using the same formwork 60 by changing the position of at least one of the joint blocks 30 as shown in FIG. 7. To make the formwork 60 suitable for the segments 10 having various lengths, an edge form should be able to move lengthwise. Since positions of the tendons are changed as the edge form moves, the positions of the tendon ducts 50 should be able to be changed. If the edge form is made of steel, it is difficult to change the positions of the tendon ducts 50 and thus an edge form corresponding to each length should be separately manufactured. However, since the joint blocks 30 are separately manufactured, the tendon ducts 50 can be installed in consideration of changed tendon positions. Accordingly, when the joint blocks 30 are used as both the ends of the formwork 60, the segments 10 of various lengths can be readily manufactured.

As described above, since the joint blocks 30 are separately manufactured and then bonded to the segment body 40, the segments 10 with complex and precise joints and the corresponding girder with improved structural integrity at the joints can be manufactured.

Although the joint blocks 30 are used as both the ends of the formwork in the above embodiments, the present invention is not limited thereto and only a single joint block may be used as an end of the formwork 60.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plurality of girder segments configured to be assembled to form a spliced prestressed concrete girder, each girder segment comprising:

at least one joint block, each joint block having a first end that has a shear key and is to be spliced to an end of an adjacent girder segment; and an elongated concrete segment body having a first distal end and a second distal end, at least one of said first and second distal ends being bonded to said at least one joint block by a bond comprising concrete cast within the elongated concrete segment body, wherein at least one of said first and second distal ends of said elongated concrete segment body matches a mating surface of said at least one joint block.

2. The plurality of girder segments of claim 1, wherein reinforcing bars are embedded in each of the joint blocks and ends of the reinforcing bars protrude from a surface of the second end of the joint block, wherein the ends of the reinforcing bars protruding from the surface of the second end of the joint block are fixedly inserted into the elongated segment body.

3. The plurality of girder segments of claim 1, wherein the material forming each of the joint blocks has a greater strength than the segment body.

4. A method of manufacturing a girder segment which is used to build a spliced prestressed concrete girder by combining a plurality of the girder segments, the method comprising:

manufacturing one or more joint blocks, each having a first end that has a shear key and is to be spliced to an end of an adjacent girder segment and having a second end that is bonded to a distal end of an elongated segment body of the girder segment; and manufacturing the elongated segment body by using the one or more joint blocks as one or more ends of a formwork in which the elongated segment body is to be made and by casting and curing concrete in the formwork, wherein the one or more joint blocks are fixedly bonded to one or more ends of the elongated segment body in the manufacturing of the elongated segment body.

5. The method of claim 1, wherein reinforcing bars are embedded in each of the joint blocks and ends of the reinforcing bars protrude from a surface of the second end of the joint block, wherein the ends of the reinforcing bars protruding from the surface of the second end of the joint block are fixedly inserted into the elongated segment body.

6. The method of claim 1, wherein the material forming each of the joint blocks has a greater strength than that of the segment body.

* * * * *